US006866382B2

(12) United States Patent
Quintana et al.

(10) Patent No.: US 6,866,382 B2
(45) Date of Patent: Mar. 15, 2005

(54) PHOTO MEDIA PRINTING

(75) Inventors: Jason Quintana, Brush Prairie, WA (US); Greg S. Smith, Carlsbad, CA (US); Wen-Li Su, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 96 days.

(21) Appl. No.: 10/016,629

(22) Filed: Nov. 1, 2001

(65) Prior Publication Data

US 2002/0054199 A1 May 9, 2002

Related U.S. Application Data

(62) Division of application No. 09/291,852, filed on Apr. 14, 1999, now abandoned.

(51) Int. Cl.[7] ..... B41J 2/01
(52) U.S. Cl. ..... 347/105; 347/101
(58) Field of Search ..... 347/101, 105, 347/106; 428/195

(56) References Cited

U.S. PATENT DOCUMENTS 5,837,375 A * 11/1998 Brault et al. ..... 428/411.1
5,998,119 A * 12/1999 Aylward et al. ..... 430/536

FOREIGN PATENT DOCUMENTS

| | | |
|---|---|---|
| EP | 0 798 129 | 10/1997 |
| GB | 2 005 596 | 4/1979 |
| GB | 2 325 647 | 12/1998 |

OTHER PUBLICATIONS

Merriam Webster's Collegiate Dictionary, 10th Ed., 1997.*
European Search Report dated Feb. 13, 2002.

* cited by examiner

*Primary Examiner*—Michael S. Brooke

(57) ABSTRACT

A method of producing and using photo media to print a glossy, photo-quality image. The image is printed onto the back of a coated transparent base. Thereafter, an opaque backing is applied to cover the printed image. The resulting print is viewed from the front, which provides the photo-quality, attractive appearance primarily because of the substantial gloss depth and uniformity attributable to the transparent base. The transparent base and backing protect the ink-receiving coating and make the resulting print very durable. The image is light fast because the ink is sandwiched between the transparent base and the backing, thereby sealing the ink from oxygen. In a preferred embodiment of the present invention, the backing is applied as a liquid using substantially the same mechanism as used for printing the image.

6 Claims, 3 Drawing Sheets

PHOTO MEDIA PRINTING

CROSS REFERENCE TO RELATED APPLICATION(S)

This is a divisional of application Ser. No. 09/291,852 filed on Apr. 14, 1999, now abandoned which is hereby incorporated by reference herein.

TECHNICAL FIELD

This invention relates to techniques for producing a photograph-quality, glossy image using an ink-jet type printer.

BACKGROUND AND SUMMARY OF THE INVENTION

Ink-jet printers are popular and cost-effective devices for producing color images. The quality of color prints made by ink-jet type printers has advanced to a level such that photo-quality images can be produced. To this end, special print media, hereafter collectively referred to as "photo media," have been developed. The photo medium usually comprises a base of white, plastic film, or bonded layers of plastic and paper. One side of the base is coated with a thin, ink-receiving coating. This ink-receiving coating provides substantially all of the photographic attributes of the medium.

In addition to absorbing ink, the ink-receiving coating must be clear to enable the white base to show through. The coating must be uniformly glossy so that the same gloss level occurs in printed and non-printed portions of the image. The ink-receiving coating also must be durable so as to be handled as a photograph. This requires resistance to scuffing, scratching, and smearing. The coating should be water-fast and, preferably, designed to isolate the ink from free oxygen, to ensure the light-fastness of the image.

The foregoing design demands of the photo media in general and the ink-receiving coating in particular can be met with an alternative approach, which is the subject of the present application. In particular, the present invention provides a new method of producing a glossy, photo-quality image. The image is printed onto the back of a coated transparent medium or base. Thereafter, an opaque backing is applied to cover the printed image. The resulting image or "print" is viewed from the front of the transparent base, which provides a photo-quality, attractive appearance. This is primarily because of the substantial gloss depth and uniformity, which characteristics are attributable to the transparent base.

As another advantage of the present invention, the transparent base and backing protect the ink-receiving coating and make the resulting print very durable. The image is light fast because the ink is sandwiched between the transparent base and the backing, thereby sealing the ink from ambient oxygen.

It will be appreciated that, because the above-mentioned design requirements of durability, uniform gloss, etc., are met by the transparent base and backing, such requirements do not apply to the ink-receiving coating, thereby simplifying the production of that coating.

In a preferred embodiment of the present invention, the backing is applied as an ink-like liquid that is thereafter dried. The liquid is applied using mechanisms substantially similar to those used for printing the image.

In another preferred embodiment, the backing is a sheet of material that is bonded to the coated, printed side of the transparent base. A versatile media handling system is provided for use in applying either the liquid backing or the sheet backing.

Other advantages and features of the present invention will become clear upon study of the following portion of this specification and the drawings.

DETAILED DESCRIPTION OF PREFERRED EMBODIMENTS

Figure 1:
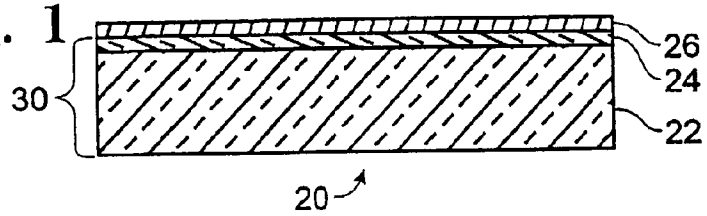
FIG. 1 is a cross sectional, greatly enlarged view of a photo-quality print produced in accord with the present invention.

FIG. 1 depicts the layers of a photo-quality print 20 produced in accord with the preferred embodiments of the present invention. The layers include a transparent base 22, comprising polyethylene terephtalate (PET) film of the type commonly used as transparencies for overhead projectors and the like.

A very thin (about 20$\mu$) ink-receiving coating 24 is applied to the base 22. This coating can be any ink-receptive layer and is preferably a transparent, colorless alumina sol-gel that is applied by any of a variety of methods such as spinning, spraying, dipping or flowing to form a coating that is then dried and cured. Also, a silica sol-gel will suffice as the ink-receiving coating 24. Hydrogels are also suitable as the ink-receiving coating 24.

Coated transparent base layers of the type considered here are readily available as supplies for ink-jet printers. An exemplary one of the many suitable types is that available from Hewlett-Packard Company of Palo Alto Calif., and designated as Premium Inkjet Transparency Film, product number C3828A.

As will be explained, the image is printed onto the ink-receiving coating 24. The side of the base carrying the ink-receiving coating 24 is designated, for the purposes of this description, as the "back" of the transparent base. In accord with preferred embodiments of the present invention, the printed image is then covered with an opaque, white backing 26 that is applied in a way to provide an intimate, gap-free bond with the ink-receiving coating 24. The finished print 20 is viewed through the front of the transparent base 22, which, as noted, provides a uniform, deep glossy surface for a photo-quality print.

In a preferred embodiment the backing 26 is "painted" over the ink-receiving coating 24. Any number of mechanisms may be employed for this painting task. Described next is an embodiment that employs the mechanisms of an ink-jet printer for both printing the image and for applying the backing 26 after the image is printed on the ink-receiving coating 24.

Figure 2:
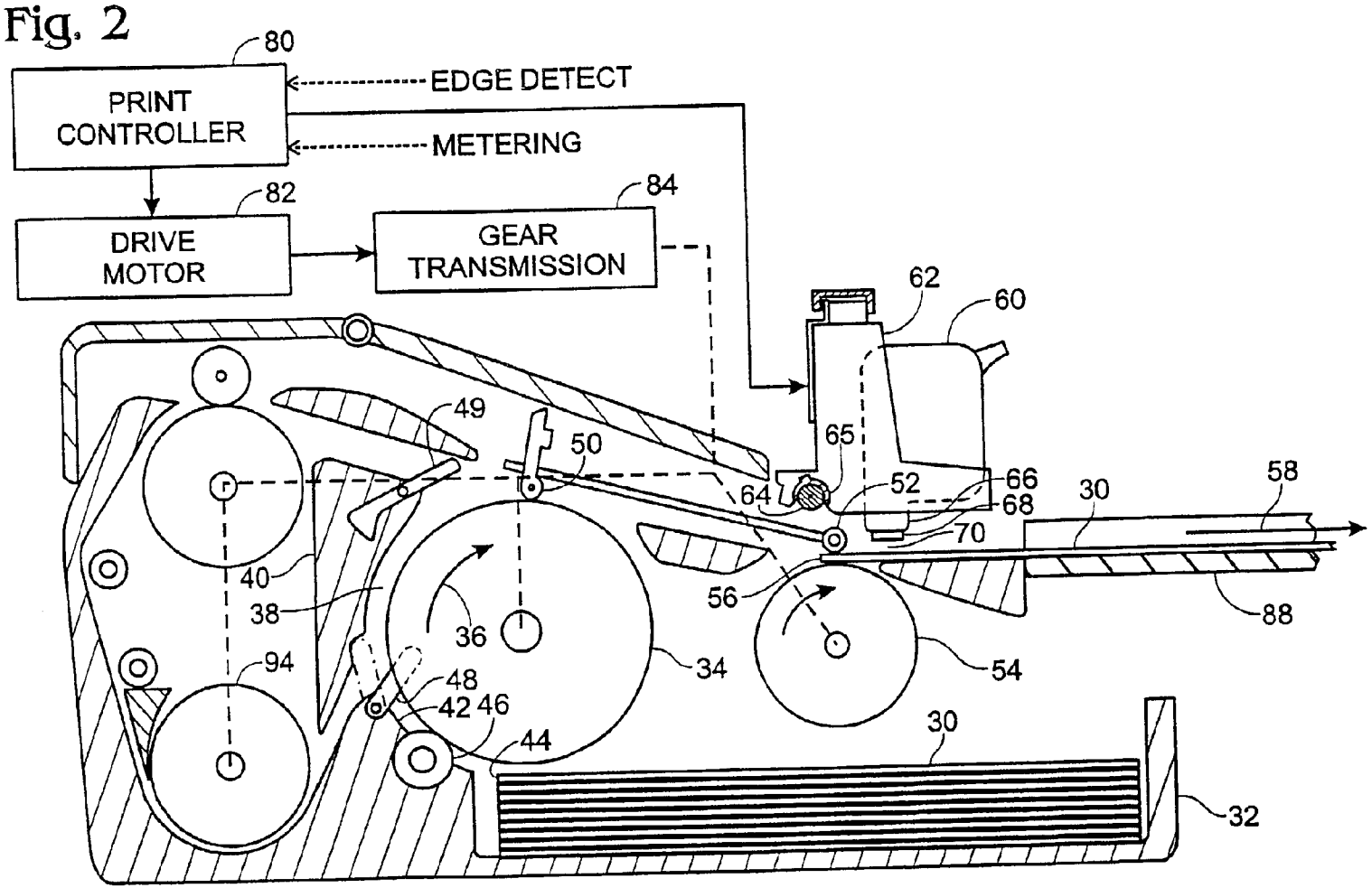
FIG. 2 is a diagram depicting in a section view the primary components of an ink-jet printer that is adapted to carry out the photo media printing of the present invention. This figure shows the printer operating to print an image onto a transparent base.

FIG. 2 depicts the primary components of an ink-jet printer that, in addition to printing the image, is adapted for applying the backing 26 as mentioned above. The printer includes an input tray 32 into which is stacked several sheets of transparent media 30, each sheet being the combination of the transparent base 22 and ink-receiving coating 24 (FIG. 1).

As the print operation commences, a sheet of media 30 is pulled by a pick roller 34 and directed as indicated by directional arrow 36 through a path 38 that is defined between the pick roller 34 and two guide members: a lower guide member 42 and an upper guide member 40. It is noteworthy here that although only individual rollers and guide surfaces appear in FIGS. 2–4, a number of such rollers and surfaces are provided, spaced apart across the width of the media sheet (i.e., in a direction normal to the plane of FIGS. 2–4).

Upon entering the passage 38, the leading edge 44 of the media sheet passes through the nip of an idler 46 and the pick roller 34 to contact a lightweight lower gate 48. The lower gate 48 is pivotally attached at one end to the printer chassis and weighted so that it normally moves under the force of gravity into a position where its free end fits between two adjacent pick rollers 34. The contact by the leading edge 44 of the media sheet 30 causes the gate 48 to swing open (counterclockwise in the figures) into the position shown in dashed lines of FIG. 2, thereby to permit the media sheet 30 to continue through the passage 38.

The media sheet 30 continues around the pick roller 34 and slips beneath an edge-detect roller 50, which moves slightly away from the pick roller 34 to accommodate the thickness of the media sheet. The edge-detect roller 50 carries a transducer that provides a signal to a microprocessor-based print controller 80 in response to the movement of the detector away from the pick roller 34. This edge information is saved in the controller memory.

The sheet 30 is guided into the nip of a pinch roller 52 and a feed roller 54. The feed roller 54 includes a position encoder that provides metering signals to the print controller, which signals correlate to the length of sheet 30 moved relative to the roller.

Near the pinch roller 52 there is mounted a container of ink, commonly known as an ink-jet cartridge 60, for printing an image onto the coated side of the media sheet 30. The cartridge 60 is removably mounted to a carriage 62. The carriage 62 is slidable along a support rod 64 that is housed within the printer. The rod extends across the printer, oriented perpendicularly to the direction the media sheet 30 is advanced through the printer. Bushings 65 may be fit into the carriage 62 to facilitate sliding.

In the present embodiment, four cartridges 60 are preferred (although only the outer one is shown in the figures) for color printing. The cartridges contain black, cyan, yellow, and magenta inks for this purpose. Each cartridge 60 includes a plastic body that comprises a liquid ink reservoir shaped to have a downwardly depending snout 66. A print head 68 (the size of which is greatly enlarged in the drawing for clarity) is attached to the end of the snout. The print head is a thermal type, formed with minute nozzles that align with chambers of ink. Each chamber has a heat transducer in it, which is driven (heated) as needed to create a vapor bubble that ejects an ink droplet through a print zone 70 onto the sheet 30.

The cartridge 60 has a circuit mounted to it (not shown) that includes exposed contacts that mate with contacts of a circuit carried inside the carriage 62. The carriage is connected, as by a flexible, ribbon-type multi-conductor to the print controller 80, which provides to the cartridges control signals for precisely timed ejection of ink droplets. The droplets render the image on the advancing sheet 30 as the carriage 62 is reciprocated across the printer.

As an alternative to the four-cartridge configuration just described, the present invention may be implemented with a single cartridge containing discrete reservoirs of the four inks, wherein each ink color is channeled to a discrete nozzle set on a single print head. Also, as will become clear, the invention may be implemented in a system that employs two interchangeable cartridges: one containing black ink and the other containing three ink colors.

Inasmuch as the present invention calls for printing of one side of the media sheet 30 for viewing through another side, one of ordinary skill will appreciate that the image data provided by the print controller 80 to the ink cartridge will be ordered in a way to print a mirror image of the image that is viewed.

In addition to controlling the ink ejection from the ink cartridge 60, the print controller 80 provides signals suitable for controlling a drive motor 82, which, via a gear transmission 84, controls the rotational speed and direction of the rollers in the printer. In this regard, the transducer carried on the edge-detect roller 50 provides a signal to the print controller 80 in response to the movement of the detector toward the pick roller 34, which movement occurs as the trailing edge 56 of the sheet 30 passes from between those rollers 50, 54 in the feed direction shown by arrow 58. Once the trailing edge 56 of the sheet 30 is detected, the print controller is apprised of the length of the media sheet 30 (as a result of a comparison of the metering signals corresponding to the opposing edges of the sheet) and drives the feed roller 54 by an amount sufficient to allow printing of the image to the margin of the sheet.

After the image is printed, the feed roller 54 is paused while the sheet 30 is supported, as by edge shelves 88, to permit partial drying of the ink. After the pause, the rotational directions of the feed roller 54 and pick roller 34 are reversed to retract the sheet 30 in preparation for "painting" the printed image with the backing 26.

Figure 3:
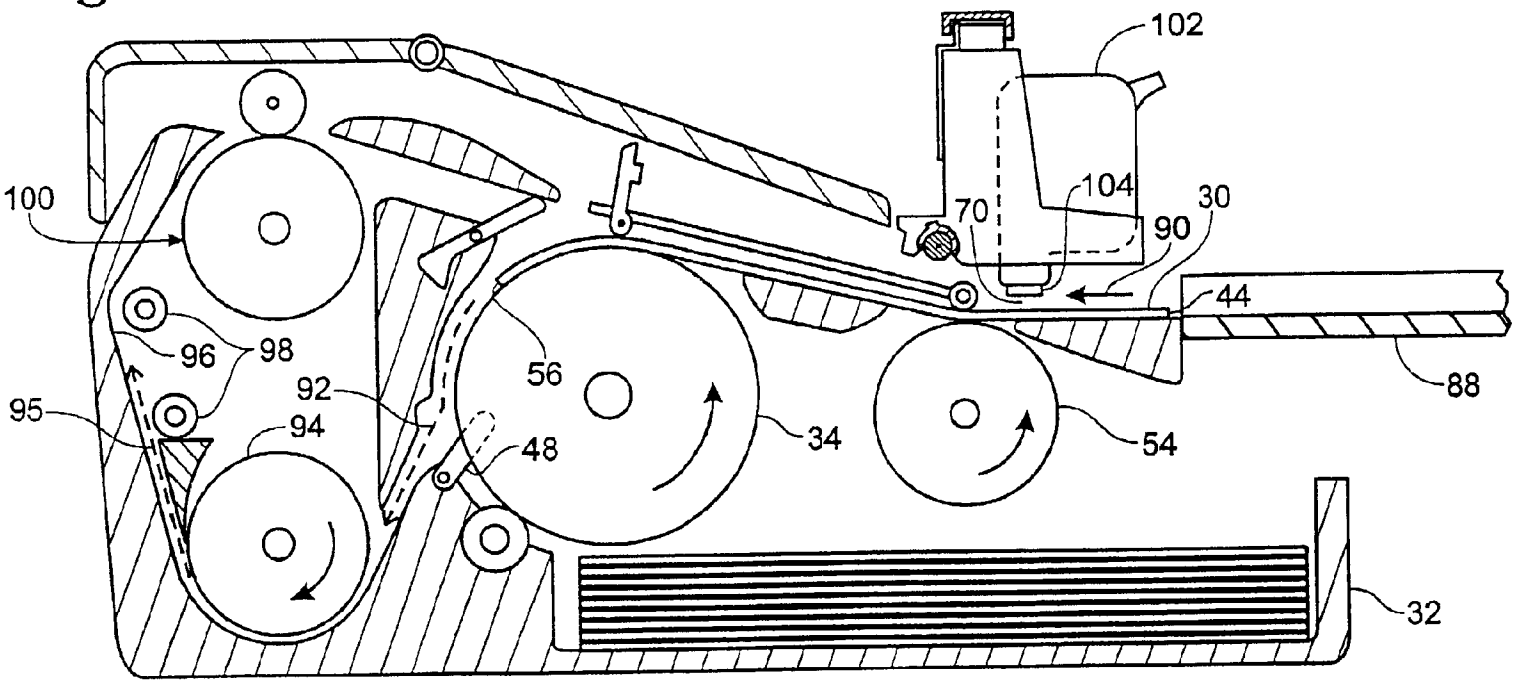
FIG. 3 is a diagram like FIG. 2 but showing the printer operating to retract the image-carrying transparent base in preparation for applying a backing to cover the image.

As shown in FIG. 3, the sheet 30 is retracted in a direction (arrow 90) opposite to the direction the sheet moved (arrow 58, FIG. 2) during printing. The edge 56 of the sheet 30 follows the pick roller 34 until engaging the gate 48, which is in the closed position (FIG. 3). The dashed arrow 92 shows the path of the retracted sheet, which moves into contact with a retraction roller 94 that is driven by the drive motor 82 as discussed above. Idler rollers associated with the retraction roller are omitted for clarity.

In a preferred embodiment, the edge 56 of the retracted sheet 30 moves away from the retraction roller 94 in the printer such as shown by arrow 95 into a space between a back guide surface 96 and two or more guide rollers 98. The retracted sheet 30 does not contact the roll 100, the significance of which is described more fully below.

The sheet 30 is fully retracted when the leading edge 44 of the sheet is moved into the print zone 70. At this time, the backing is applied. To this end, one of the ink cartridges, the black ink cartridge, is swapped with a backing container 102 such as shown in FIG. 3. This container 102 holds the backing in liquid form and is shaped to match the configuration of the ink cartridges 60 (hence, easily fitting into the carriage 62).

As to the make-up of the liquid backing, any liquid that dries as an opaque, preferably white, layer will suffice, provided that the image is unaffected by the application of the backing or its application.

In the preferred embodiment, the backing liquid is a composition much like black ink used in ink-jet printing, except for the substitution of titania particles for carbon black. More particularly, the backing liquid is a solution of 5 to 10% by weight polyvinyl alcohol (5% being preferred) and 2 to 10% by weight titania particles (2% preferred) having a maximum size of less than about 100 nanometers. In order to ensure complete coating of the titania particles, the solution is subjected to ultrasonication for at least 10 minutes.

Without undue experimentation one could certainly arrive at other formulations for the backing liquid. For example, one concerned with ensuring the liquid is absolutely opaque may use titania in an amount more than 10% by weight. In any event, the backing liquid can be considered a white paint that is opaque when dry and thereby provides an effective photo-media backing.

The backing liquid of the present embodiment is applied in a manner analogous to printing. In this regard, a print head 104 is connected to the backing container 102 in a manner and location that matches the print head 68 of an ink cartridge 60. The print head is a thermal type, as described above, although one could employ any drop-on-demand type print heads, such as a piezoelectric type.

The print controller 80 controls the carriage 62 and backing container print head 104 to eject the backing liquid by an amount sufficient to cover the printed image as the media sheet 30 is advanced through the printer in a manner described above in connection with FIG. 2. Once the backing is applied and dried, the edge shelves 88 are moved to permit the finished print to drop into an output tray (not shown).

It is contemplated that the backing container 102 can be mounted independently of the ink cartridge(s) 60, thus obviating the need for swapping one for the other. For instance, the overall carriage size could be increased to carry a fifth container, the backing liquid container 102. Also, a separate carriage assembly could be provided sufficiently downstream (i.e., relative to arrow 58, FIG. 2) to apply the backing without the need for retracting the sheet 30 as described above. This downstream support of a backing liquid container is depicted in dashed lines of FIG. 4, with the backing container shown at 103 and the separate carriage (or extension of the same carriage 62) shown at 63. Also, in such an embodiment, a page-wide array of backing liquid print heads could be provided for eliminating the need for a reciprocating carriage having backing-liquid containers. These alternative approaches would increase throughput.

As noted earlier, another embodiment of the present invention employs as a backing 26 of the print 20 (FIG. 1) a sheet of material that is bonded to the coated side of the transparent base 22. The media handling system just described in connection with the prior embodiment, however, can be employed in applying either the liquid backing or the sheet backing.

Figure 4:
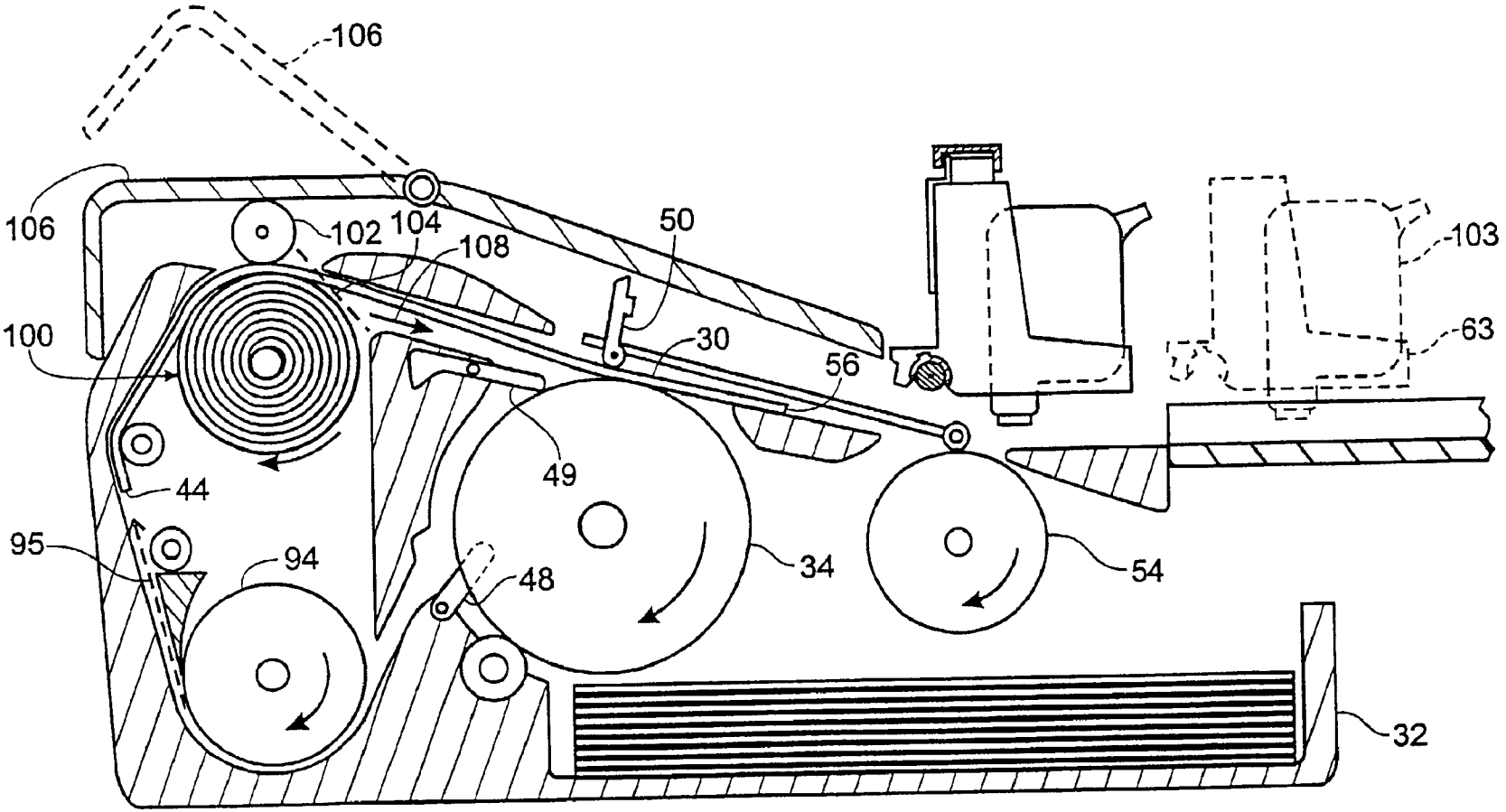
FIG. 4 is a diagram like FIGS. 2 and 3 but showing the printer in an alternative embodiment wherein the image-carrying transparent base is moved against and adhered to a sheet of opaque backing material.

This alternative embodiment is described with reference to FIG. 4. In short, the media sheet 30 carrying the printed image is retracted by the retraction roller 94 (along the direction indicated by arrow 95) by an amount such that the edge 56 of the sheet 30 engages the nip between a pressure roller 102 and a roll of backing material 100.

The backing material 100 comprises a white plastic film that is coated with a transparent, pressure-sensitive adhesive, which adhesive faces outwardly to contact the ink-receiving coating 24 of the sheet 30. The adhesive-coated film 100 can be considered as a pressure-sensitive tape. The geared drive motor 82 drives the pressure roller 102 such that the backing tape is bonded to the sheet as the sheet advances between the roller 102 and roll 100.

It is noteworthy here that best results are obtained when the sol-gel of the ink-receiving layer 24 is prepared to be translucent or "milky" in appearance, thereby to effectively hide any adhesive that may appear on non-printed portions of the image. This translucence in the sol-gel can be accomplished by blending titania into the sol-gel mixture before it is applied as the ink-receiving coating 24.

As the edge 56 of the sheet 30 is directed to the pick roller 34 (in the direction of arrow 108) it encounters a lightweight upper gate 49. That gate 49 is pivotally attached at one end to the printer chassis and is weighted so that it normally moves under the force of gravity into a position (See FIG. 2) where its free end prevents any media sheets from moving toward the roller in a direction opposite arrow 108 (FIG. 4). The contact by the edge 56 of the media sheet 30 causes the gate 49 to swing open (clockwise in the figures) into the position shown in FIG. 4, thereby to permit the media sheet 30 to continue in the direction of arrow 108 through the passage toward the pick roller 34.

After the edge detect roller 50 contacts the edge 56 of the advancing, backed sheet 30, the print controller 80 controls the pick roller 34 and pressure roller 102 so that the edge 44 of the sheet is stopped at a location (shown as dashed line 104) just past the nip of the pressure roller 102 and roll 100. The user is then prompted to open the rear cover 106 of the printer to sever the tape at the location 104. When the tape is severed, the printed advances the backed sheet to the output tray.

As yet another alternative embodiment, the white, opaque backing can be prepared as individual sheets and applied, using a conventional lamination process, to the image printed as described in connection with FIG. 2. Such an approach would obviate the need for the above-described mechanisms for retracting the printed image.

Irrespective of which backing embodiment is selected (liquid "painting," separate sheets, etc.) in one or more embodiments of the present invention, the backing, transparent base 22, or both, may be waterproof. Additionally, in one or more embodiments of the present invention, the backing, transparent base, or both, may be constituted to provide scratch resistance, ultraviolet (UV) radiation protection, and/or fluorescence.

Although preferred and alternative embodiments of the present invention have been described, it will be appreciated by one of ordinary skill that the spirit and scope of the invention is not limited to those embodiments, but extend to the various modifications and equivalents as defined in the appended claims.

What is claimed is:

1. A method of producing a glossy print, comprising the steps of:

coating a transparent medium with a translucent ink-receiving coating;

printing an image onto the translucent ink-receiving coating; and applying a backing over the printed image, thereby to produce a glossy print of the image as viewed through the transparent medium.

2. The method of claim 1 wherein the applying step includes the step of bonding the backing to the transparent medium to cover the printed image.

3. The method of 2 wherein the bonding step includes moving the transparent medium after printing the image so that a side of the transparent medium carrying the printed image contacts and adheres to a sheet of opaque backing material.

4. The method of claim 1 wherein the coating step includes blending titania particles with a sol gel mixture to produce the translucent ink-receiving coating.

5. A printed photo media article, comprising:

a transparent medium having a coating of translucent ink-receiving material on a first side thereof;

an image printed onto the translucent ink-receiving coating; and a backing adhered to the first side of the medium to cover the printed image and ink-receiving coating, thereby to provide a glossy print of the image as viewed through the transparent medium.

6. The apparatus of claim 5 wherein the translucent ink-receiving coating comprises titania particles blended with a sol gel mixture.

* * * * *